US006058531A

United States Patent [19]

Carroll

[11] Patent Number: 6,058,531

[45] Date of Patent: May 9, 2000

[54] DUAL-POSITION ASSIST AND GUARD RAIL FOR BEDS

[75] Inventor: Timothy J. Carroll, London, Canada

[73] Assignee: Carroll Intelli Corp., London, Canada

[21] Appl. No.: 08/862,245

[22] Filed: May 23, 1997

[51] Int. Cl.[7] ..... A47C 21/08

[52] U.S. Cl. ..... 5/430; 5/428

[58] Field of Search ..... 5/430, 428, 425

[56] References Cited

U.S. PATENT DOCUMENTS

| | | | |
|---|---|---|---|
| 2,817,854 | 12/1957 | Pratt | 5/428 |
| 2,817,855 | 12/1957 | Pratt | 5/430 |
| 3,021,534 | 2/1962 | Hausted . | |
| 3,055,020 | 9/1962 | Mann . | |
| 3,585,659 | 6/1971 | Burst et al. | 5/430 |
| 3,971,083 | 7/1976 | Peterson . | |
| 4,612,679 | 9/1986 | Mitchell | 5/45 |
| 4,993,089 | 2/1991 | Solomon et al. | 5/430 |
| 5,216,768 | 6/1993 | Bodine et al. | 5/430 |
| 5,381,571 | 1/1995 | Gabhart | 5/430 |
| 5,384,927 | 1/1995 | Mardero et al. | 5/662 |
| 5,678,267 | 10/1997 | Kinder | 5/430 |

*Primary Examiner*—Alexander Grosz

[57] ABSTRACT

An improvement is provided in a bed having a side rail framework, and at least one dual-position rail assembly which is secured on one side of the bed. The improvement includes a rotatable structure upon which the dual-position rail assembly, is mounted in order to enable the dual-position rail assembly to move between two positively-stopped and automatically locked positions. A first of such positively-stopped and automatically locked positions disposes the dual-position rail assembly in an assist, vertically-oriented, position which is perpendicular to the longitudinal axis of the bed. A second of such positively-stopped and automatically locked positions disposes the dual-position rail assembly in a guard, horizontally-oriented, position which is parallel to the longitudinal axis of the bed. The lock structure for assuring such stopped and locked position is one which automatically locks and maintain the assist dual-position rail in a selected one of the positively-stopped and automatically locked first position, or the positively-stopped and automatically locked second position. The dual-position rail assembly is not adopted to be operated by the occupant of the bed, but it can be selectively, otherwise operated to aid a person in getting in or out of bed, or to restrain the person within the bed.

20 Claims, 6 Drawing Sheets

DUAL-POSITION ASSIST AND GUARD RAIL FOR BEDS

BACKGROUND OF THE INVENTION (a) Field of the Invention

This invention relates to side guards or rails for beds. More particularly, it relates to such side guards or rails which are movable between two differently-oriented, positively-stopped and locked positions, and to mechanisms to enable the moving of the rails between such positions. One particularly useful such rail is for hospital beds. However, the assist and guard rail is useful for all beds having a side rail framework.

(b) Description of the Prior Art

As noted above, one particular use for such rail is for hospital beds. Hospital beds had rails along the sides thereof for two purposes. One purpose of such bed rail structure along the edges of the bed was to prevent the patient from falling out of bed. The early prior art devices that were employed for this purpose used rigid frame members that were clamped, when in use, to the side of the bed. While these devices seemed to serve the purpose for which they were intended, they brought about the disadvantage that they made it difficult to treat the patient and also caused considerable difficulty during the changing of the sheets or blankets on the bed.

To provide an alleged improvement over such primitive devices, standard hospital-type beds generally now include side rails which may be of two types. One type comprised a single-piece tubular side rail structure which extended substantially the length of the bed and which must be lifted off to allow the patient to be moved, or, if the patient was movable, to allow the patient to exit or to enter the bed. The other typical type comprised a similar side rail structure which had a complicated and expensive hinged mechanism to allow the side rail to be lowered to the floor. This was thought to be more convenient for the aide, but it was impossible for the patient to manoeuvre if the patient was in the bed.

Accordingly, the art next developed bed rail devices that were, in a sense, retractable so that the rail devices could either be placed in an "up" position or could be moved to a "down" position, in order to render the top surface of the bed easily accessible. Safety bed rails and side guards which were especially adapted to prevent persons from falling out of bed are thus How well known. Various constructions of such bed guards provided such bed guards which were movable between a raised position, in which the bed guard was supported at a level above the surface of the bed mattress and a retracted or lowered position in which the bed guard was either moved out of the way toward one end of the bed, or was lowered to a position below the mattress.

Several other types and forms of retractable devices have also been provided, but they have been found to have one or more of the following disadvantages. First, in several types of such devices of the prior art, the bed rail mechanism was not movable through a vertical plane that was parallel to the edge of the bed. In such cases, it was necessary that the bed be moved from its position against the wall in order to effectuate retraction of the guard rail.

Secondly, most of the known prior art devices are not equipped to withstand force applied horizontally thereof. More specifically, it has been found that most prior art devices having retractable features provided adequate support against accidental pivoting through the intended plane of movement, there had, in the past, been no adequate provision for withstanding force applied normal to the direction of the intended movement.

While many types of operating mechanisms have been previously devised for movable bed guards, such prior bed guards have been susceptible to pinching or otherwise injuring the extremity of the attending person who operates the lowering or retracting mechanism. Thus, it was necessary to operate such devices carefully to prevent injury.

Parallel links or arms constitute one arrangement for supporting a side guard so that it will move easily between the two positions. In this arrangement, two parallel arms extended between the side guard and the movable back section on which the head end of the mattress rested, those links being of equal length and rotatably connected both to the side guard and the back section. Thus, the side guard moved upwardly or downwardly when the links rotated, yet remained at the same angle with respect to the back section. In order to enable the side guard to rise high enough to be effective in its purpose, and still to drop low enough so as not to interfere with the changing of sheets or the replacement of a mattress, the two parallel arms must be quite long. This, however, detracted from the stability of the side guard, making it somewhat wobbly in its upper position. It further caused the side guard to undergo a lengthy translational movement when passing between the two positions, and this requires considerable clearance at the end of the side guard.

In parallelogram linkages of guard rail structures of the prior art, the upright and horizontal members have been subject to a scissors action, particularly during collapsing movement of the rail structure but also to some extent in raising movement thereof. This required great care on the part of the nurse or other operator of the structure to avoid pinching the fingers or other members of either the operator or the patient. Garments and bedclothes were also apt to be pinched in prior art collapsible side rail structures.

Another typical bed rail mechanism used vertical support members which were slidably attached to the bed frame such that the bed rail can be raised and lowered vertically. These sliding-type mechanisms typically locked the bed rail in the raised position by use of a pin engaging a hole in the vertical support member or by a clamping means. That mechanism had been subject to the loss of component parts. Further, such bed rails can be relatively heavy and awkward for a given operator to raise and lower. If such bed rails were not lowered evenly, they tended to bind, become difficult to move and can jam in an undesired position.

Another purpose of side rails was to assist persons getting into or out of the bed. Many persons, especially as they became older or became infirm, had difficulties in moving from the siting to the standing position and vice versa. Devices have been previously proposed for attachment to a bed to provide a rail which was adjacent to the side of the bed to assist the person. However, the previous designs were generally unsatisfactory for attachment to bed frame arrangements of the type readily available in U.S.A. and Canada and were generally unsatisfactory for providing a stable and readily adjustable support for the person.

The patent literature has provided alleged improvements to the above-described rail systems of hospital beds.

U.S. Pat. No. 2,817,855, patented by Pratt, disclosed a guard frame which was pivotally mounted upon a frame member of a bed and was movable from an upper guarding position to a lower unguarding position by rotating its supporting members around the pivotal mountings.

U.S. Pat. No. 3,021,534, patented Feb. 20, 1962, by Ray K. Hausted, provided an adjustable bed rail assembly which included first and second adaptor brackets which were secured to the side rails. A pair of link arms was pivoted to the brackets and was swingable through a vertical plane. A rigid frame of generally quadrilateral configuration was provided, the frame having adjacent corner portions that were pivoted to the free ends of the link arms, so that the opposed sides of the frame may be moved into and out of position in alignment with the link members upon relative pivotal movement there between. At least one bracket was provided which had a U-shaped pocket within which the link arm which was pivoted thereto may be received, with the link arm being in alignment with an opposed side of the frame.

U.S. Pat. No. 3,055,020, patented Sep. 25, 1962, by Stuart Nelson Mann, provided a restraining structure for beds, which comprised a parallelogram linkage. It included a pair of spaced upright channel members which were disposed with their open side facing with other and which were adapted to be pivoted at their lower ends to the side portion of the framework of a bed. Flanged portions of the channel members had portions projecting therefrom toward the other channel member to form pairs of spaced bearing portions which were offset substantially from the channel members proper. A plurality of vertically-spaced, horizontally-extending tubular members had their ends pivoted between pairs of the bearing portions to form a parallelogram linkage. Stop means were provided for limiting downward pivotal movement of the upright members to a predetermined oblique position. The pivot axes of the bars were offset from the channel members proper by a sufficient distance so that, during collapsing movement of the parallelogram linkage, the approaching sides of the channel members and the tubular members maintained substantial spacing to avoid pinching.

U.S. Pat. No. 3,585,659, patented Jun. 22, 1971, by Francis J. Burst et al, provided a safety side guard for hospital beds. The guard was mounted upon the mattress supporting frame of the bed by mounting means that included trunnions which were journalled in a mounting bracket that was fixed upon the frame. The guard was movable from an elevated guarding position to a lowered inoperative position, causing rotation of the trunnions in their journals. A spring pressed latch which was mounted in the bracket secured the guard in elevated position, and top means limited movement of the guard both up and down. The mounting bracket was mounted on the frame and was disposed well below the patient in the bed, and hence, was not readily accessible to the patient, although it was readily accessible to a nurse when it was desired to lower the guard.

U.S. Pat. No. 3,971,083, patented Jul. 27, 1976, by Warren J. Peterson, provided a side guard for beds which was movable between raised and lowered positions and which included a latch apparatus which could be released with the knee of an attending person in such a manner as to prevent injury of that person's knee during such movement. The safety bed rail assembly included a pivot assembly which was adapted to allow movement between the raised and the lower position without injury to the operator. In its raised position, the safety rail prevented persons in bed from falling out of bed and provided useful assistance in moving into and out of bed. In the lowered position, the guard was positioned below the mattress level to allow a nurse or other bed attendant to tuck bed clothes under the mattress without the rail obstructing the operation and to move easily around the bed and patient to administer injections or other treatments. When so lowered, the rail was spaced sufficiently above the floor to provide clearance for cleaning and movement of stands and the like thereunder.

U.S. Pat. No. 4,612,679, patented Sep. 23, 1986, by Larry D. Mitchell, provided a bed side guard assembly, which was movable between elevated and depressed positions on parallel swing arms that were quite short and extended from a base which was mounted on the back section of the bed. It had an upper section which pivoted outwardly and downwardly to a retracted position substantially to reduce the height of the side guard. When the side guard was in its depressed position with its upper section folded to the retracted position, the side guard lay entirely below the mattress supporting surface of the bed back section and therefore did not interfere with bed making. The parallel swing arms had spindles which projected into the base, where they rotated as the side guard moved between its elevated and depressed positions, and those spindles carried crank arms that were connected by a tie bar. A latch bolt lay in the path of the tie bar to hold the side guard in its elevated position. The tie bar, by coming against one or other of the spindles, prevented the side guard from going past its elevated or depressed positions.

U.S. Pat. No. 4,993,089, patented Feb. 19, 1991, by Robert A. Solomon, et al, provided a bed rail mechanism, wherein a multi-link mechanism was used to attach a bed rail to a bed frame so that the rail could be easily raised to its elevated position and locked in place. Alternatively, the rail could be easily released and placed in the lowered position. The mechanism used a movable framework to guide the bed rail in an arcuate path between its elevated and lower positions. A diagonal linkage was provided to lock the mechanism and bed rail in the elevated position. A counterbalance mechanism was also provided so the operator need not struggle with the weight of the rail.

U.S. Pat. No. 5,216,768, patented Jun. 8, 1993, by Oliver H. Bodine, et al, provided a bed system, which included a patient-operable side rail to be attached to one side of the bed and which was rotatable in a plane which was parallel to the plane of the bed, on the side to which it was attached. The side rail was rotatable so as to serve as a barrier. Rotation of the side rail only 90° was permitted to set the rail into its open stopped position. Optional engagable locking means were manually, but not automatically, operable to lock the rail in the closed position or in the open position.

U.S. Pat. No. 5,381,571, patented Jan. 17, 1995, by Thomas S. Gabbart, provided a pivotal and lockable hospital bed guard, as a closure mounted on a bed rail at a gap. The bed guard was movable between a first position maintaining the gap and a second position closing the gap to prevent patient movement through such gap. The closure had a first end, which included a rotation means, the rotation means being carried by the guard rail. A first lock was provided for securing the closure in a first locking position with the closure means being adapted to be positioned adjacent to, generally parallel to, and coextensive with, the guard rail, thereby maintaining the gap. A second lock was provided for securing the closure in a second locking position closing the gap. The first and the second locks were operated by a single handle. Means were provided for engaging the first and the second locking means.

U.S. Pat. No. 5,384,927, patented Jan. 31, 1995, by Steve Mardero et al., provided a security rail attachment for a bed, which included a post with an adjustable foot at the lower end. A rail portion was mounted within the post and was rotatable about the vertical axis of the post. An attachment rail extended across the end of the bed and included clamping elements for clamping to angle irons along the sides of the bed. The rotatable rail portion could be latched at four 90° spaced-apart positions by notches in the base of a vertical post of the rail portion which cooperated with a transverse pin in the post. The rail portion could therefore project outwardly from the bed at right angles thereto for assisting the occupant in standing, or could lie along the side of the bed to assist the occupant to prevent the occupant from falling from that side of the bed.

SUMMARY OF THE INVENTION (a) Aims of the Invention

In spite of these patented alleged improvements, there is still a need for a rail assembly to assist a person in movement in and out of a bed.

It is one object of this invention to provide a rail assembly that is swingable through a vertical plane between two desired stopped positions and which can effectively withstand horizontal force applied against it same when in either of these two stopped positions.

A further object of this invention is to provide a rail assembly that does not require a large clearance along the bed to accommodate the translational movement that accompanies the change between either of its two stopped positions.

A still further object of this invention is to provide a rail assembly which reduces the potential for injury to persons by providing controlled movement between an assist position and a guard position.

Yet another object of this invention is to provide an improved dual-position rail assembly for a bed.

An additional object of this invention is to provide a dual-position rail assembly which is relatively economical and which is easy to manipulate, and yet is low in cost.

(b) Statements of Invention

The present invention, in one embodiment, provides an improvement in a bed having a side rail structure, and at least one dual-position rail assembly which is mounted on such side rail structure, the improvement including: a rotatable structure which is mounted upon the dual-position rail assembly, to enable the dual-position rail assembly to move between two positively-stopped and automatically locked positions, a first of the positively-stopped and automatically locked positions disposing the dual-position rail assembly in an assist, vertically-oriented, position which is perpendicular to the longitudinal axis of the bed, and a second of such positively-stopped and automatically locked positions disposing the dual-position rail assembly in a guard, horizontally-oriented, position which is parallel to the longitudinal axis of the bed; and locking means for maintaining the dual-position rail assembly in an automatically locked selected one of the first positively-stopped and automatically locked position or the second positively-stopped and automatically locked position.

The present invention, in another embodiment, provides a dual-position rail assembly for a bed comprising: a dual-position rail assembly; pivot means for supporting the dual-position rail assembly to enable the dual-position rail assembly to move between two positively-stopped and automatically locked positions, a first of the positively-stopped and automatically locked positions disposing the dual-position rail assembly in an assist, vertically-oriented, position which is perpendicular to the longitudinal axis of the bed, and a second of such positively-stopped and automatically locked positions disposing the dual-position rail assembly in a guard, horizontally-oriented, position which is parallel to the longitudinal axis of the bed, the positively-stopped and automatically locked positions being provided by means for limiting pivotal movement of the dual-position rail assembly, and by locking latch means for selectively, but automatically, locking the dual-position rail assembly in each of the first, positively-locked and automatically locked position and the second, positively-locked and automatically locked position; and including means for allowing the pivotal movement of the dual-position rail assembly between the two positively stopped and automatically locked positions.

The present invention, in yet another embodiment, provides a dual-position rail assembly for a bed comprising: a support bracket; at least one pair of parallel rails which are secured to the support bracket; means for enabling pivoting of the combined support bracket and the parallel rails between two positively-stopped and automatically locked positions, a first of the positively-stopped and automatically locked positions disposing the combined support bracket and the parallel rails in an assist, vertically-oriented, position which is perpendicular to the longitudinal axis of the bed, and a second of such positively-stopped and automatically locked positions disposing the combined support bracket and the parallel rails in a guard, horizontally-oriented, position which is parallel to the longitudinal axis of the bed, the positively-stopped and automatically locked positions being provided by means for limiting pivotal movement of the combined support bracket and the parallel rails and by automatically lockable and latchable means for selectively holding the combined support bracket and the parallel rails in each of the first, positively-stopped and automatically locked position, and the second, positively-stopped and automatically locked position, for locking the pivotal movement of the combined support bracket and the parallel rails at the two, positively-stopped and automatically locked positions.

The present invention in a still further, and preferred, embodiment, provides a 90-degree-rotatable rail for mounting to a bed which has a side rail frame structure, comprising: a bracket structure for mounting to a side rail frame structure of the bed; a rail structure which is secured to the bracket, the rail structure comprising a rigid, quadrilateral framework with a pair of parallel legs supporting the framework, the legs being joined by a rectangular plate, the rectangular plate including an abutment plate secured thereto; a bilobed cam disc which is secured to the bracket structure and which is rotatably mounted with respect to the rectangular plate, the rail thereby being rotatable in a clockwise direction from a first, positively-stopped and automatically locked, orientation, where the length of the rectangular framework is parallel to the side rail, and where a first lobe of the bilobed cam disc abuts one face of the abutment plate, and being rotatable in a counter-clockwise direction from the first, positively-stopped and automatically locked orientation to a second, positively-stopped and automatically locked orientation, where the length of the rectangular framework is perpendicular to the side rail, and where a second lobe of the bilobed cam disc abuts another face of the abutment plate; and cooperating and automatically lockable means between the bilobed cam disc and the rectangular plate automatically, but selectively, to lock the rail structure either in the first, positively-stopped and automatically locked orientation, or in the second, positively-stopped, and automatically locked orientation.

(c) Other Features of the Invention

By one feature of the first embodiment of the invention, the locking means comprises a pair of selectively engagable lock mechanisms.

By one feature of the preferred embodiment of this invention, the bracket structure of the rail structure comprises a U-shaped channel member which is fixedly secured to a base post and which extends perpendicularly therefrom.

By another feature of the preferred embodiment of this invention, the bilobed cam plate is fixedly secured to the base post and extends perpendicularly thereto, whereby the longitudinal plane of the bilobed cam plate is parallel to the longitudinal plane of the U-shaped channel member.

By other features of the preferred embodiment of this invention, the fixed securing is by welding.

By yet another feature of the preferred embodiment of this invention, the cooperating means comprises a pin which is mounted on the rectangular plate, and which is selectively movable to rest within a selected aperture of two 90 degree spaced-apart apertures in the bilobed cam disc. By a specific feature of this feature, the pin is a spring-loaded pin.

By still another feature of the preferred embodiment of this invention, an additional longitudinally-extending bar is provided within the rigid quadrilateral framework.

Figure 1:
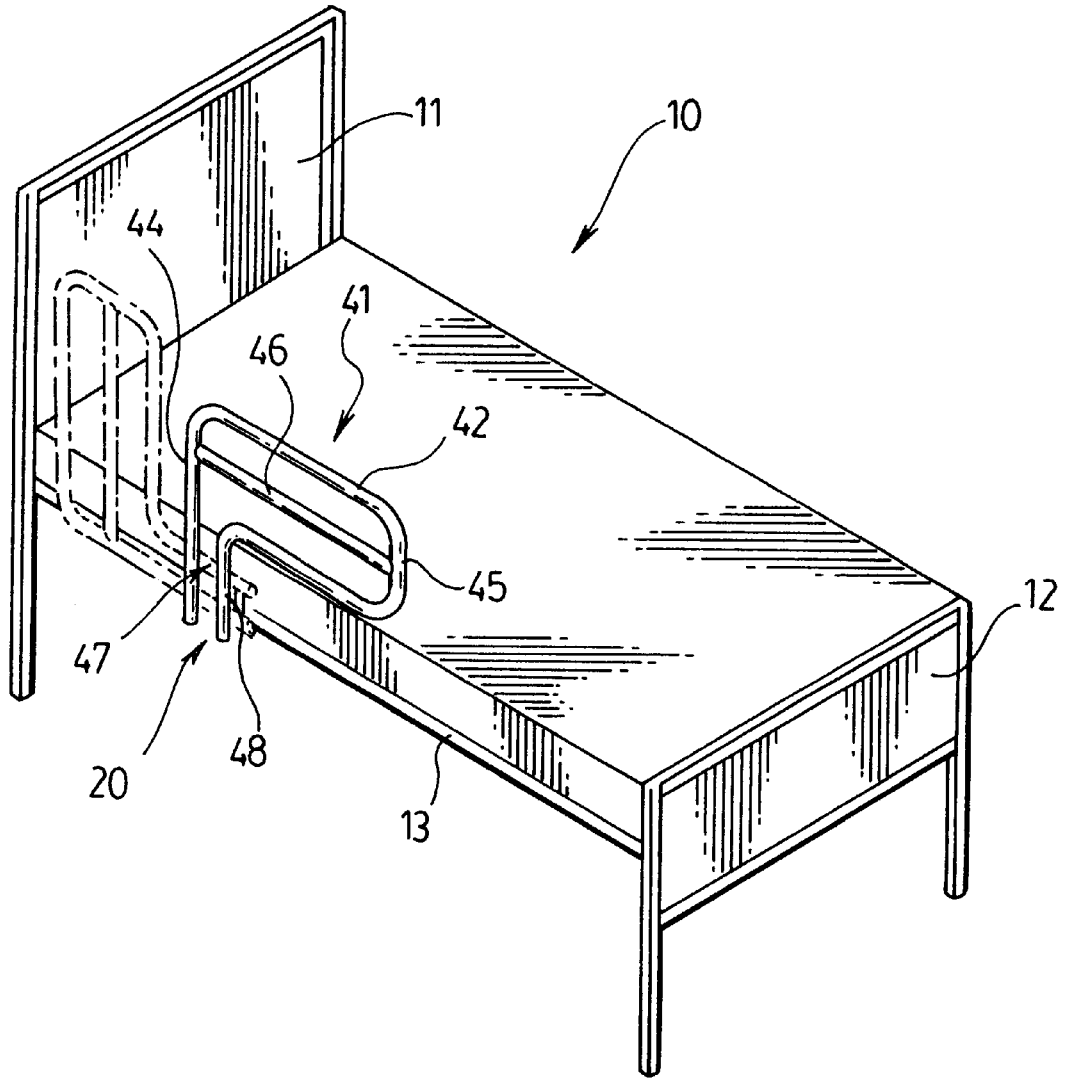
FIG. 1 is a perspective view of a bed including a dual-position rail assembly according to one embodiment of this invention.
Figure 2:
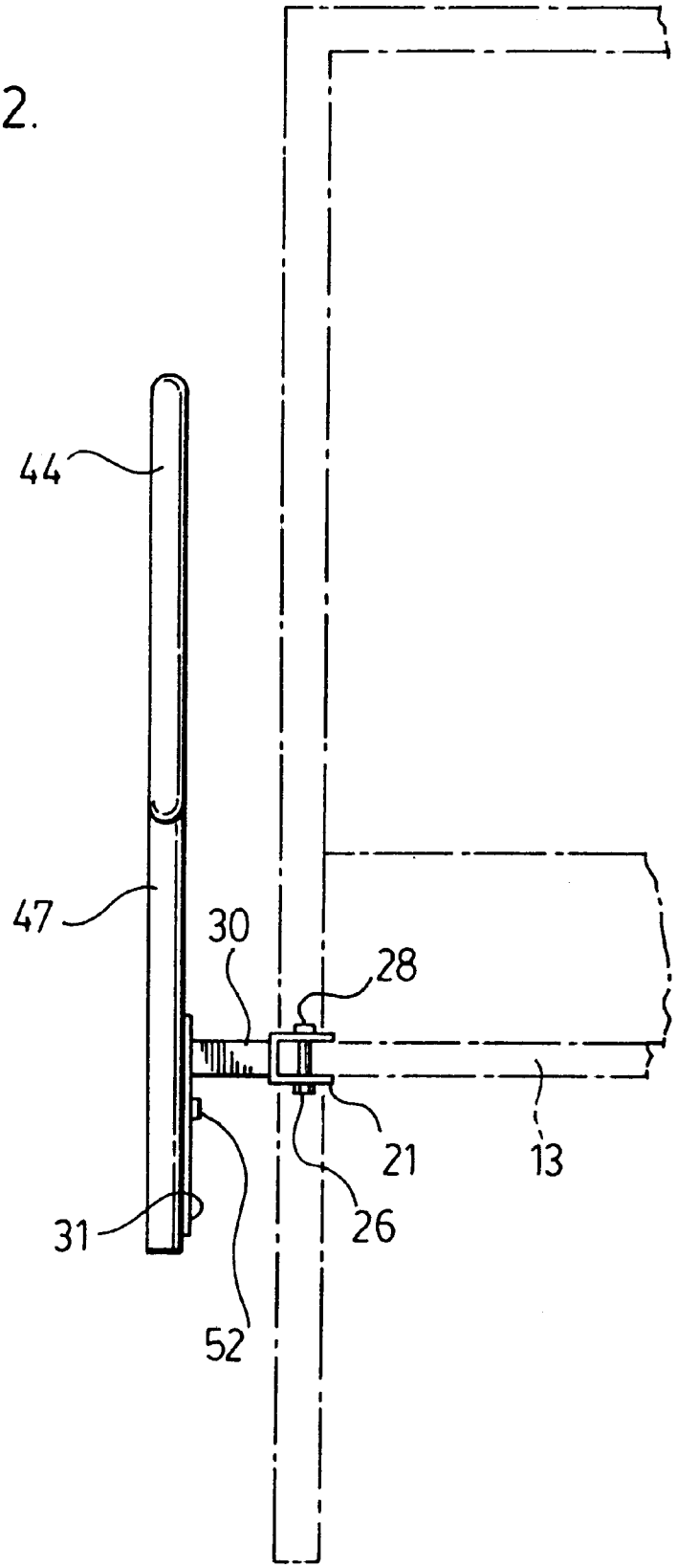
FIG. 2 is an enlarged end view of the embodiment of the dual-position rail assembly of one embodiment of this invention shown in FIG. 1.

DESCRIPTION OF PREFERRED EMBODIMENTS (a) Description of FIGS. 1 & 2

One preferred embodiment of this invention is on a hospital bed. The hospital bed 10 as seen in FIGS. 1 and 2, includes a headboard 11, a footboard 12 and a pair of side rails, (only one 13 being seen), extending therebetween on both sides of the bed. The rail structure 20 is secured to the side rail 13 in a manner which is more clearly seen in FIGS. 2, 3 and 6.

Figure 4:
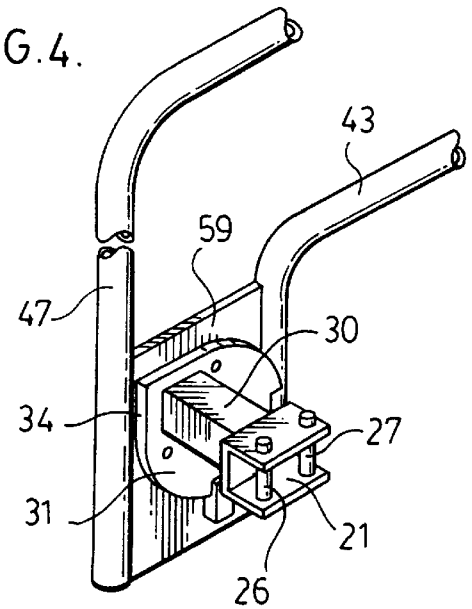
FIG. 4 is a perspective view of the assembled embodiment of FIG. 3 for use on the left side of a bed.
Figure 3:
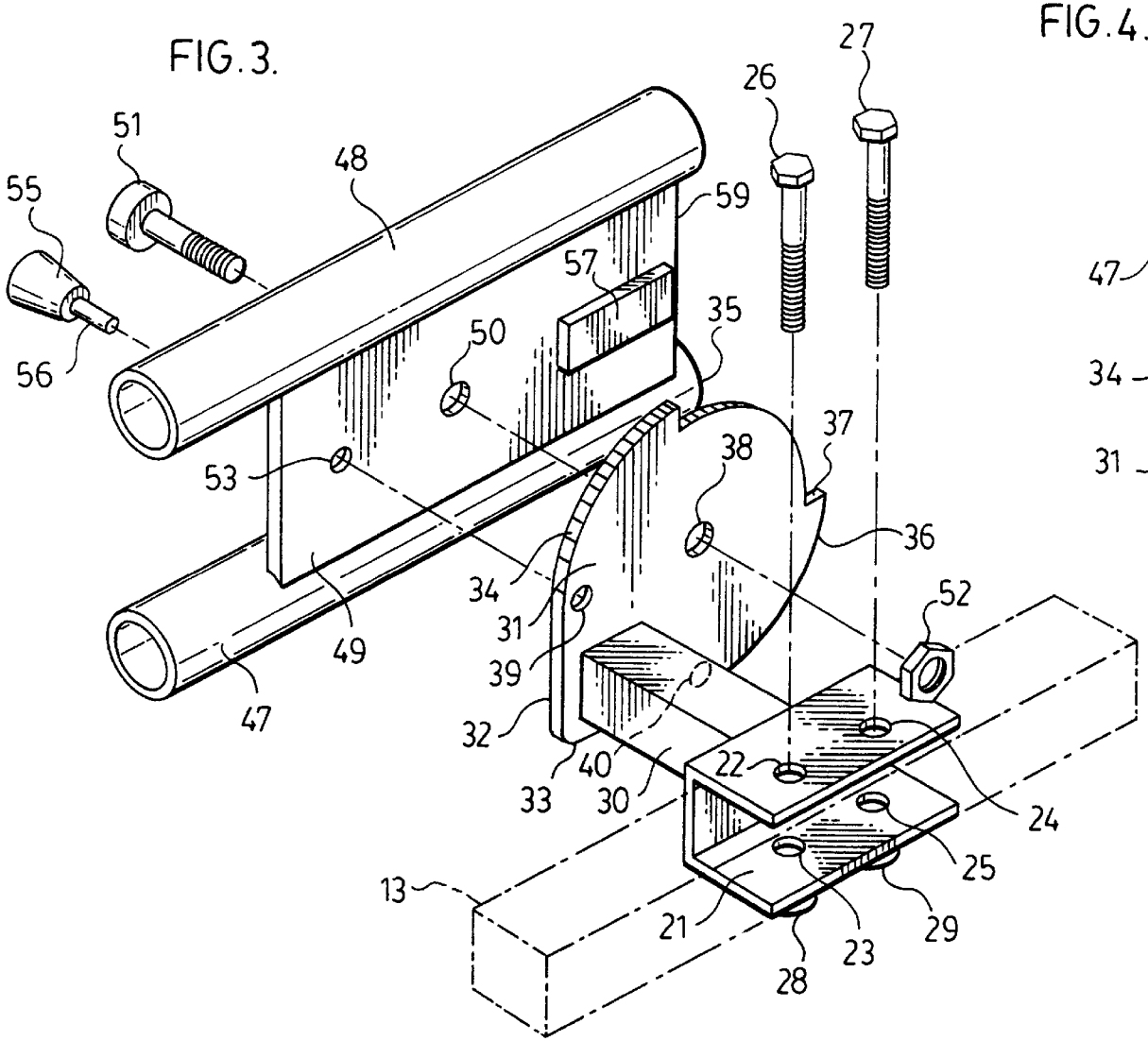
FIG. 3 is an exploded perspective view of the dual-position rail assembly according to one embodiment of this invention for use on the right side of a bed.

(b) Description of FIG. 3 and FIG. 4

Turning now to FIG. 3 and FIG. 4, the rail structure includes a U-shaped channel bracket 21 which is provided with aligned apertures 22,23 and 24,25, through which bolts 26,27, respectively, pass through bores (not shown) in the side rail 13, to be secured by way of nuts 28,29, respectively.

A base post 30 is secured at right angles to bracket 21 and extends transversely therefrom. A bilobed cam disc 31 is secured at right angles to the base post 30 and extends longitudinally therefrom. Thus, the longitudinal plane of the cam disc 31 is parallel to the longitudinal plane of the bracket 21.

The bilobed cam plate 31 includes an upper corner, which is adjacent to the base post 30, and which is defined by a horizontal edge 32 and a vertical edge 33. The horizontal edge 32 curves downwardly at arcuate edge 34 to end at first lobe 35. The vertical edge 33 curves downwardly at arcuate edge 36 to end at second lobe 37. Cam plate 31 includes a central bore 38 and two 90 degree spaced apart apertures, namely, aperture 39 which is adjacent to edge 32 and aperture 40 which is adjacent to edge 33.

The rail 20, as seen in FIG. 1, includes a rectangular framework 41, which is provided by an upper horizontal bar 42 and a lower horizontal bar 43, the horizontal bars being joined by vertical bars 44,45. An auxiliary horizontal bar 46 is also provided between vertical bars 44, 45. The vertical bar 44 includes an extension providing one leg 47, and the lower horizontal bar merges with a second, and parallel, leg 48, (see also FIGS. 1, 5 and 6).

Legs 47, 48 are joined together and rigidified by a rectangular plate 49. The rectangular plate 49 includes a bore 50 by means of which shaft/bolt 51 rotatably secures the rectangular plate 49 to the cam disc 31 by passing through aligned bores 50, 38. The rectangular plate 49 is so rotatably secured to the cam disc 31 by nut 52. It is also seen that the rectangular plate 49 also includes a counterbored aperture 53/54, (see also FIGS. 7, 8 and 9), within which a spring-loaded pin 55 is secured. The spring-loaded pin 55 includes a sprung pin 56, as well as a spring (not seen). The rectangular plate 49 is also provided with a vertically-oriented abutment plate 57, which is disposed adjacent to the bottom edge 59 of the rectangular plate 49.

Figure 5:
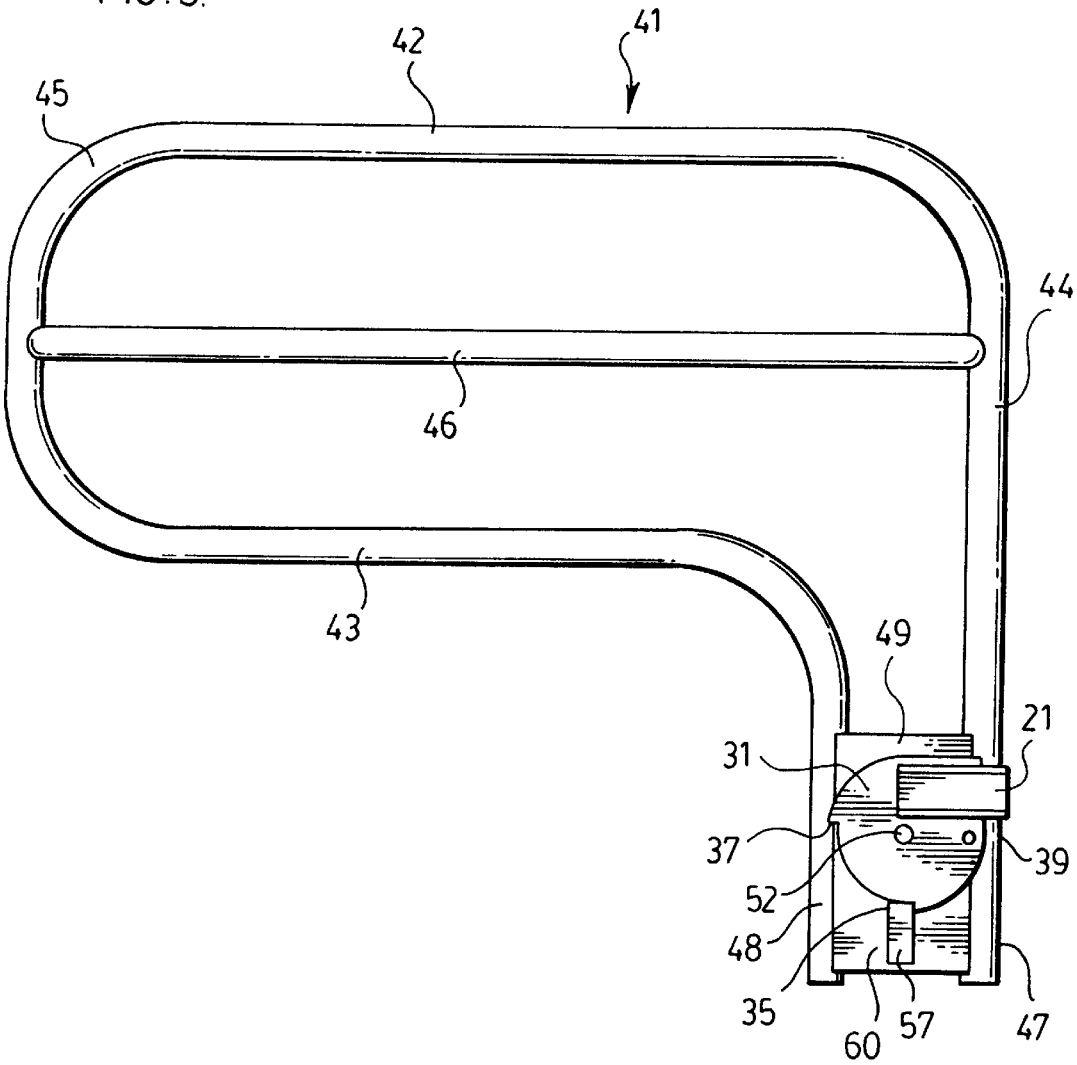
FIG. 5 is an enlarged posterior view of the embodiment of the dual-position rail assembly of one embodiment of this invention shown in FIG. 1, in its substantially horizontal orientation (first or guard position), for use on the right side of a bed.

(c) Description of FIG. 5

The rail 20 is shown in FIG. 5 in its first (or guard rail) orientation. In such orientation, the first lobe 35 abuts against edge 60 of abutment plate 57, thereby to provide a stop. The pin 56 is seen to rest in aperture 39 to provide a locked first orientation.

Figure 6:
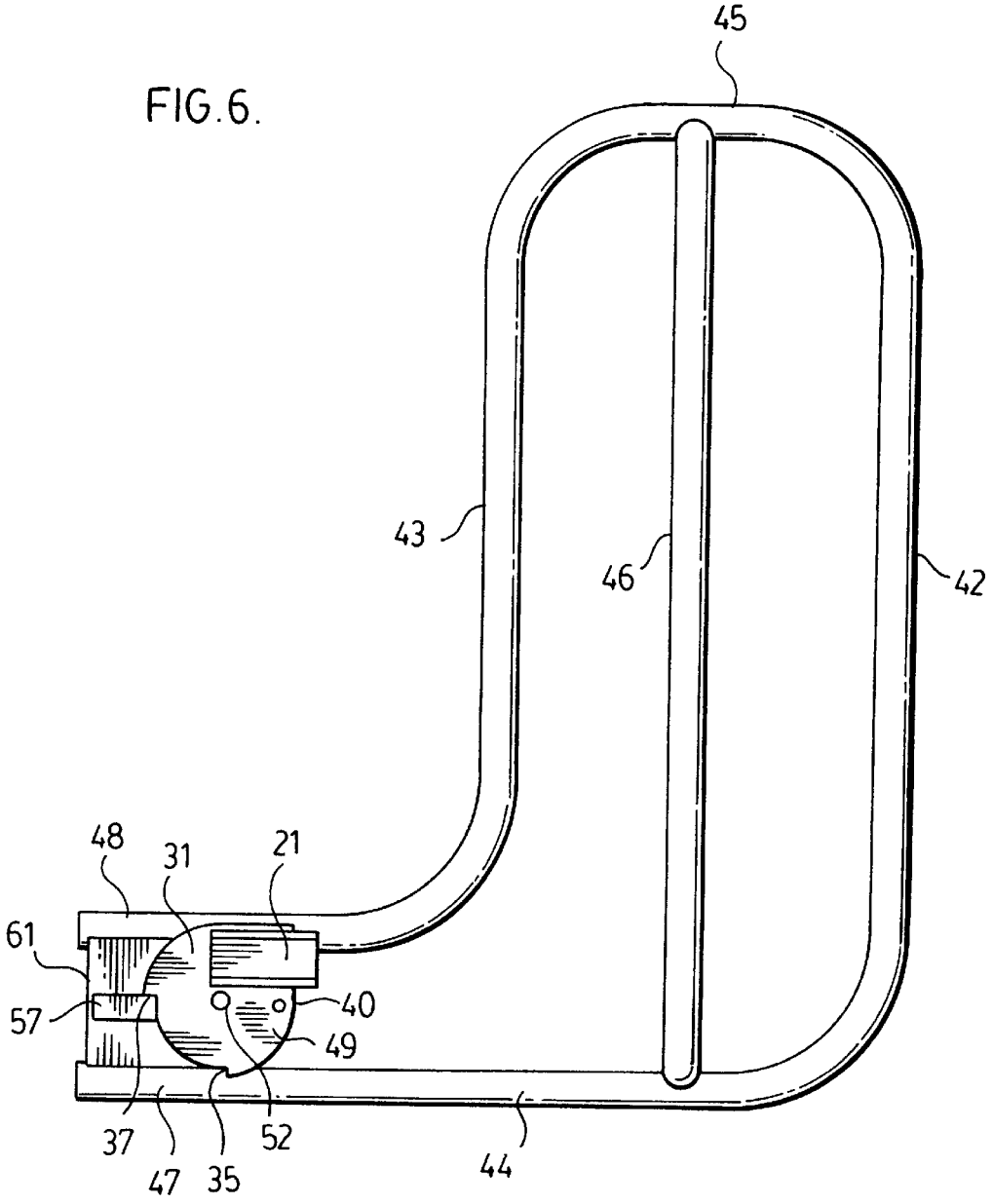
FIG. 6 is an enlarged posterior view of the embodiment of the dual-position rail assembly of one embodiment of this invention shown in FIG. 1, in its substantially vertical orientation (second or assist position), for use on the right side of a bed.

(d) Description of FIG. 6

The rail 20 is shown in FIG. 6 in its second (assist rail) orientation. In such orientation, the second lobe 37 abuts against edge 61 of abutment plate 57, thereby to provide a stop. The pin 56 is seen to rest in aperture 40 to provide a locked second orientation.

Figure 7:
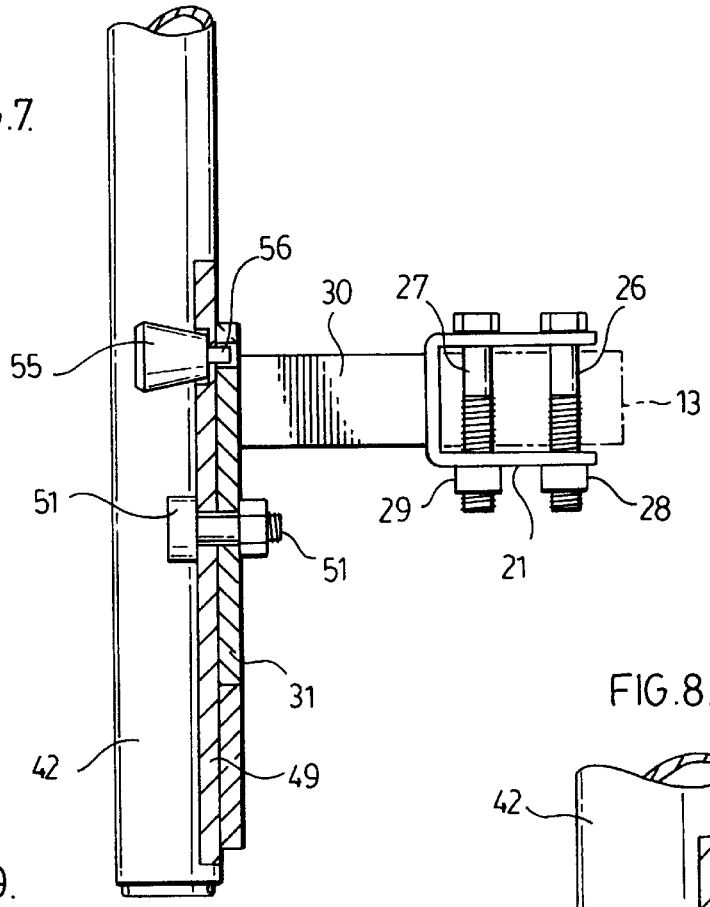
FIG. 7 is a cross-section through the dual-position rail assembly and bracket of one embodiment of this invention shown in FIG. 1, showing the locking mechanism.
Figure 8:
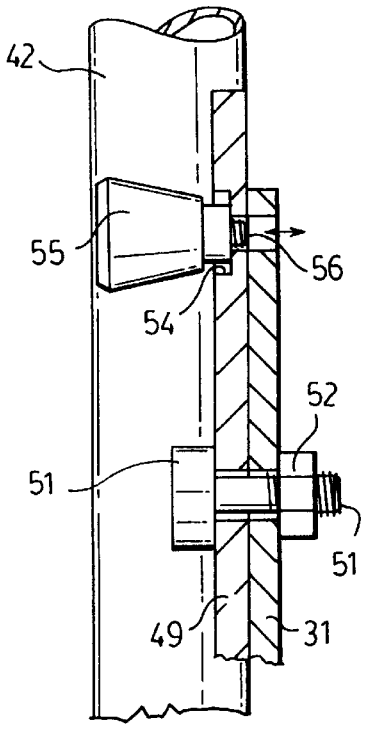
FIG. 8 is a partial view of FIG. 6 showing the operation of the locking mechanism.
Figure 9:
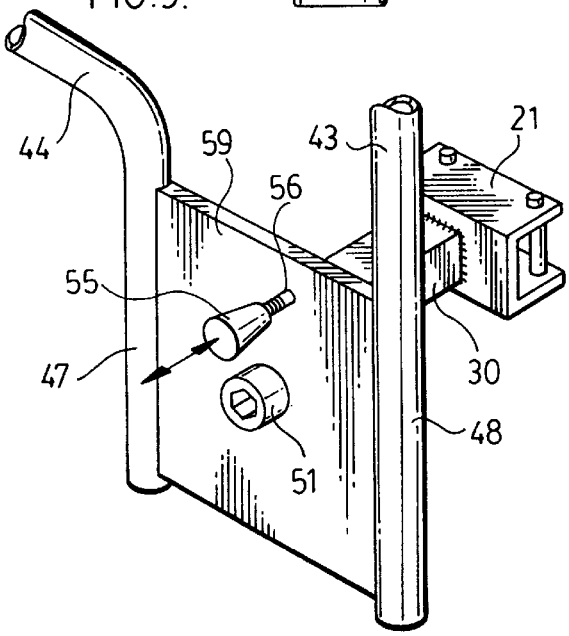
FIG. 9 is a perspective view of the locking mechanism shown in FIG. 7 and FIG. 8.

OPERATION OF THE INVENTION (a) Description of FIG. 7, FIG. 8 and FIG. 9

In use, to move the rail assembly 20 from its first (or guard rail) orientation, (which is shown in solid lines in FIG. 1) to its second (or assist rail) orientation, (which is shown in broken lines in FIG. 1), it is necessary first to grasp the spring-loaded pin 55, then to pull the sprung pin 56 out of its aperture 39 in the cam disc 31. Then, the rail assembly 20 is rotated in a counter-clockwise direction until the lobe 35 and abuts the face 61 of the abutment plate 57. The sprung pin 56 of the spring-loaded pin 55 springs home into the aperture 39 in the cam disc 31, to provide the locked second orientation.

In a like manner, to move the rail assembly 20 from its above-described second orientation, to its above-described first orientation, it is necessary first to grasp the spring-loaded pin 55, then to pull the sprung pin 56 out of its aperture 40 in the cam disc 31. Then, the rail assembly 20 is rotated in a clockwise direction until the lobe 37 abuts the face 61 of the abutment plate 57. The sprung pin 56 of the spring-loaded pin 55 springs home into the aperture 31 in the cam disc 31, to provide the locked first orientation.

CONCLUSION

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and intended to be, within the full range of equivalence of the following claims.

I claim:

1. A 90-degree-rotatable rail structure for mounting to a framed bed which has a side rail frame structure comprising: a bracket structure for mounting to one said side rail of said side rail frame structure (21) of said bed; a rail structure (41) which is secured to said bracket structure, said rail structure comprising a rigid, quadrilateral framework with a pair of parallel legs (43,44) supporting said framework, said legs being joined by a rectangular plate (49), said rectangular plate including an abutment plate (57) secured thereto; a bilobed cam disc (31) which is secured to said bracket structure and which is rotatably mounted with respect to said rectangular plate, said rail structure thereby being rotatable from a first, positively-stopped and automatically locked orientation, where the length of said rectangular framework is parallel to said side rail, and where a first lobe (35) of said bilobed cam disc abuts another face of said abutment plate to a second, positively-stopped and automatically locked orientation, where the length of said rectangular framework is perpendicular to said side rail, and where a second lobe (37) of said bilobed cam disc abuts one face of said abutment plate, and also being rotatable from said second, positively-stopped and automatically locked orientation back to said first, positively-stopped and automatically locked position; and cooperating automatically lockable means between said bilobed cam disc and said rectangular plate selectively, and automatically, to lock said rail structure in said first, positively-stopped and automatically locked, orientation or in said second, positively-stopped and automatically locked, orientation.

2. The 90-degree-rotatable rail structure for mounting to a bed as claimed in claim 1, wherein said bracket of said rail structure comprises a U-shaped channel member (21) which is fixedly secured to a base post and which extends perpendicularly therefrom.

3. The 90-degree-rotatable rail structure for mounting to a bed as claimed in claim 2 wherein said bilobed cam plate is fixedly secured to said base post and extends perpendicularly thereto, whereby the longitudinal plane of said bilobed cam plate is parallel to the longitudinal plane of said U-shaped channel member.

4. The 90-degree-rotatable rail for mounting to a bed as claimed in claim 3, wherein said cooperating means comprises a pin (55) which is mounted on said rectangular plate, and which is selectively movable to rest within a selected aperture of two 90 degree spaced apart apertures (39, 40) in the bilobed cam disc.

5. The 90-degree-rotatable rail structure for mounting to a bed as claimed in claim 4, wherein said pin (55) is a spring-loaded pin.

6. The 90-degree-rotatable rail structure for mounting to a bed as claimed in claim 3, wherein said fixed securing is by welding.

7. The 90-degree-rotatable rail structure for mounting to a bed as claimed in claim 2 wherein said fixed securing is by welding.

8. The 90-degree-rotatable rail for mounting to a bed as claimed in claim 2, wherein said cooperating means comprises a pin (55) which is mounted on said rectangular plate, and which is selectively movable to rest within a selected aperture of two 90 degree spaced apart apertures (39, 40) in the bilobed cam disc.

9. The 90-degree-rotatable rail structure for mounting to a bed as claimed in claim 8, wherein said pin (55) is a spring-loaded pin.

10. The 90-degree-rotatable rail structure for mounting to a bed as claimed in claim 1, wherein said bilobed cam plate is fixedly secured to said base post and extends perpendicularly thereto, whereby the longitudinal plane of said bilobed cam plate is parallel to the longitudinal plane of said U-shaped channel member.

11. The 90-degree-rotatable rail structure for mounting to a bed as claimed in claim 10, wherein said fixed securing is by welding.

12. The 90-degree-rotatable rail for mounting to a bed as claimed in claim 10, wherein said cooperating means comprises a pin (55) which is mounted on said rectangular plate, and which is selectively movable to rest within a selected aperture of two 90 degree spaced apart apertures (39, 40) in the bilobed cam disc.

13. The 90-degree-rotatable rail structure for mounting to a bed as claimed in claim 12, wherein said pin (55) is a spring-loaded pin.

14. The 90-degree-rotatable rail structure for mounting to a bed as claimed in claim 1, wherein said fixed securing is by welding.

15. The 90-degree-rotatable rail for mounting to a bed as claimed in claim 1, wherein said cooperating means comprises a pin (55) which is mounted on said rectangular plate, and which is selectively movable to rest within a selected aperture of two 90 degree spaced apart apertures (39, 40) in the bilobed cam disc.

16. The 90-degree-rotatable rail structure for mounting to a bed as claimed in claim 15, wherein said pin (55) is a spring-loaded pin.

17. The 90-degree-rotatable rail structure for mounting to a bed as claimed in claim 1, wherein an additional longitudinally-extending bar (46) is provided within said rigid quadrilateral framework.

18. A rail assembly for attachment to a bed comprising: an elongated rail rotatably attached to said bed, said rail being rotatable between a first, automatically locked guardrail position and a second, automatically locked assist rail position.

19. A rail assembly according to claim 18, having a hinge plate located between said elongated rail and said bed, said hinge plate incorporating a stop positioned to prevent said elongated rail from rotating beyond said second automatically locked assist rail position.

20. A rail assembly according to claim 19, wherein said hinge plate further includes a second stop positioned to prevent said elongated rail from rotating beyond said first, automatically locked guardrail position.

* * * * *